US005091062A

United States Patent [19]

Revell

[11] Patent Number: 5,091,062

[45] Date of Patent: Feb. 25, 1992

[54] WEB BARRIER PACKAGING MATERIAL

[75] Inventor: Kenneth M. Revell, Thetford, England

[73] Assignee: Bowater Packaging Limited, London, England

[21] Appl. No.: 544,543

[22] Filed: Jun. 28, 1990

[30] Foreign Application Priority Data

Jun. 29, 1989 [GB] United Kingdom ..... 8914881

[51] Int. Cl.[5] ..... C25D 11/02

[52] U.S. Cl. ..... 205/138; 205/139; 205/316; 205/321; 205/323; 205/333

[58] Field of Search ..... 204/28, 56.1, 58

[56] References Cited

U.S. PATENT DOCUMENTS

| | | | |
|---|---|---|---|
| 3,442,686 | 5/1969 | Jones | 428/336 |
| 4,158,079 | 6/1979 | Severus-Laubenfeld | 428/172 |
| 4,190,321 | 2/1980 | Dorer | 350/165 |

*Primary Examiner*—T. M. Tufariello

*Attorney, Agent, or Firm*—Oblon, Spivak, McClelland, Maier & Neustadt

[57] ABSTRACT

A metallized web of barrier packaging material e.g. metallized plastic film, is made transparent to microwaves (without loss of its barrier properties) by passing it through an electrolyte in a bath to anodize the metal and convert it to its oxide and/or hydroxide.

5 Claims, 1 Drawing Sheet

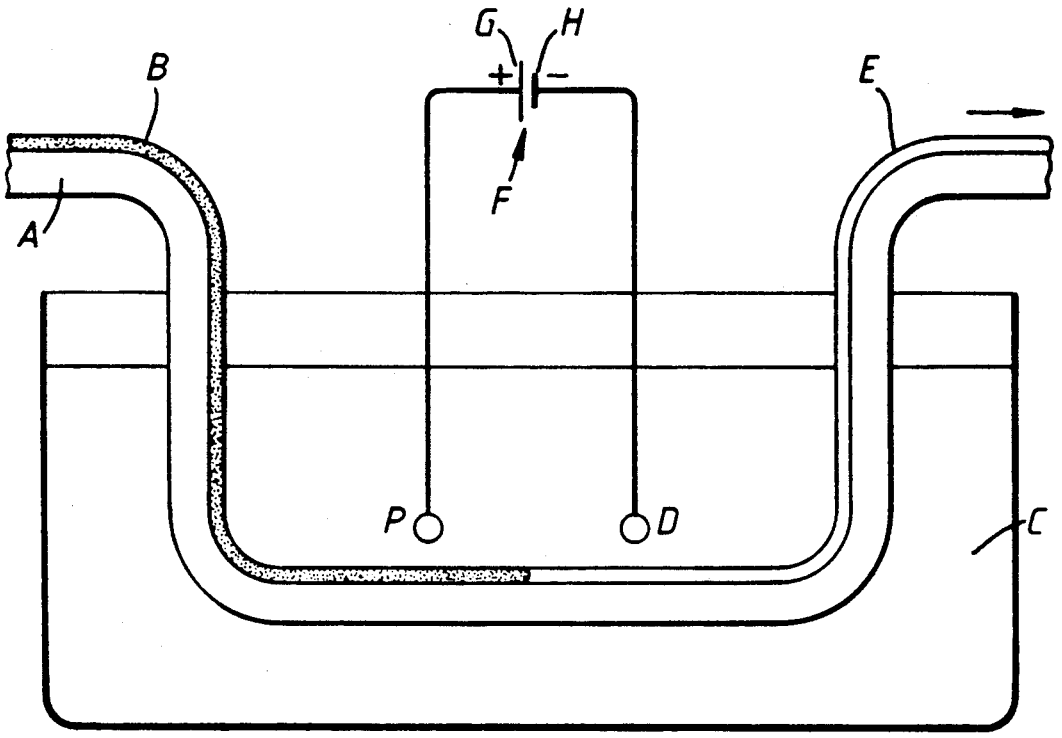
G
H
+
−
B
E
F
A
P
D
C

WEB BARRIER PACKAGING MATERIAL

This invention relates to web barrier packaging materials and to a process for their production. The materials are especially, but not exclusively, useful as components of barrier packs for products sensitive to oxygen and/or water vapour, and for barrier packs for oxygen sensitive foodstuffs which are intended to be heated in microwave ovens.

It is generally accepted that barrier packaging materials for products (such as foodstuffs) sensitive to oxygen require an oxygen permeability of less than 5 cc/meter$^2$/24 hours, and preferably less than 1 cc/meter$^2$/24 hours (at 23° C., 50% RH), and that barrier packaging material for products (such as foodstuffs) sensitive to water vapour require an MVTR (moisture vapour transmission rate) of less than 5 gram/meter$^2$/24 hours and preferably less than 1 gram/meter$^2$/24 hours (at 38° C., 90% RH). In the following text, all references to materials having good barrier imply the meeting of these criteria.

Web materials coated with thin layers of metals produced by evaporation or sputtering of said metals in vacuo are well known, and are normally referred to as metallised films. Many such metallised films, notably those coated with aluminium, have good barrier to oxygen and/or water vapour, and are useful as components of barrier packaging materials. However, the metal coatings are not transparent to light or to microwave radiation, which restricts the usefulness of these films in some areas of packaging.

Web materials coated with thin layers of metal or non-metal oxides such as the oxides of aluminium, tin or silicon, by evaporating of such oxides in vacuo, using techniques such as electron beam evaporation, are also known. Such materials can have good barrier to oxygen and/or water vapour and are transparent to light and microwave radiation. However, many such oxides tend to decompose or dissociate on evaporation into lower oxides and oxygen. Removal of the oxygen by the vacuum pumps, particularly at the higher deposition rates necessary to make the process economically viable for the production of packaging films, can then result in deposition of an oxide with a stoichiometry different from that originally evaporated, and such "mixed oxides" are often coloured or have poorer or more variable barrier properties. Depending on process conditions (notably pressure), crystallinity and morphology of the deposited oxide can vary and as a consequence barrier properties can be inconsistent. It is said in U.S. Pat. No. 3,442,686 that for good barrier, the oxide coating must be in the "glassy" rather than the crystalline state.

Monitoring and control of the oxide layer thickness by conventional techniques used in metallisation (such as measurement of light transmission) is also difficult because the oxide is transparent.

It is also known to produce barrier coatings of such oxides by the process of sputtering in vacuo, but this process is very slow and consequently not viable for most packaging applications.

It is also known to convert some metals such as aluminium to the oxide or hydroxide by treating with water or steam. The oxidation can be accelerated by making the metal the anode of an electrolytic circuit and applying an electric potential. This process is termed anodising. Its application to aluminium articles such as window frames is well known. The process can also be applied to web materials such as composites of a metal foil and a plastic film, or a metallised plastic film, as described in publications such as U.S. Pat. No. 4,158,079 and U.S. Pat. No. 4,190,321. The material is normally suspended in or passed through a bath of aqueous electrolyte, the metal layer being connected to the positive terminal of an electric power source and another electrode, suspended in the electrolyte, being connected to the negative terminal. Using anodising, the metal layer can be oxidised superficially or substantially, but not completely, because oxidation is not uniform and preferential oxidation of certain areas will eventually break the electrical circuit and anodisation then ceases, leaving zones of residual metal. However, this residual metal can then be converted to oxide by immersing the film in a solution of an oxidising agent, as described in U.S. Pat. No. 4,190,321.

Although oxidation of metallised films to oxide coated films using water, steam or anodising/chemical oxidation produces a web material with improved light transmission characteristics compared with the uncoated substrate, which is useful for applications such as glazing, the oxide coating so produced is generally believed to be in a non-glassy state and as such does not have good barrier. In U.S. Pat. No. 4,190,321 the coating produced by treating aluminium with water or steam is described as made up of a plurality of randomly positioned discrete leaflets and to be porous. No claims are made for any barrier properties to oxygen, other gases or water vapour, and indeed repetition of the examples described in U.S. Pat. No. 4,190,321 confirm that the coatings have no significant barrier. Even example 5 of said patent, in which the metallised aluminium coating is anodised in an electrolyte comprising 50% (by volume) $H_2SO_4$ in water gives a non-barrier oxide coating.

We have now found that, despite this prior art teaching, it is in fact possible to anodise metallised web materials to oxidise most of the metal layer to produce oxide or hydroxide coated web materials which are not only substantially transparent to both light and microwave radiation but also have good and consistent barrier properties to oxygen, other gases and water vapour, similar to the original metallised film. Also, the process can readily be monitored by measuring change in light transmission. The materials so made are useful for conversion to composites for packaging products (such as foodstuffs) sensitive to oxygen or water vapour; and products packed in said materials can be heated in microwave ovens.

In one aspect, the invention provides a process for treating a metallised web of barrier packaging material in order to make it microwave transparent without significant loss of its oxygen and water vapour barrier properties, which comprises passing the metallised film through an electrolytic bath to anodise the metal and convert it to its oxide and/or hydroxide.

In another aspect, the invention provides a web of microwave transparent barrier packaging material which comprises a metallised support wherein the metal is substantially anodised to its oxide and/or hydroxide, said material having an oxygen permeability of less than 5 cc/m$^2$/24 hours and a moisture vapour transmission rate of less than 5 g/m$^2$/24 hours.

The invention also includes a method of making a microwave transparent barrier packaging material which comprises subjecting a metallised support material to an electrolytic treatment to anodise the metal layer so that the treated material has good barrier to oxygen and to moisture vapour.

In accordance with one preferred feature of the present invention, the anodising process is carried out in an electrolyte containing far less electrolyte, e.g. $H_2SO_4$, than Example 5 of U.S. Pat. No. 4,190,321 referred to above. Thus, for example, we have found that in order to obtain good barrier, electrolyte concentrations (e.g. $H_2SO_4$) of below 10% by weight and most preferably of about 1% or below, are needed.

One preferred embodiment of the invention uses as the starting material, film which has been metallised within the previous 48 hours or less (preferably 12 hours or less) and has thus not yet developed substantial layers of oxide at the film/metal interface due to oxidation by oxygen and/or moisture adsorbed in the substrate. If such film is oxidised by the process of anodising, as described herein, residual metal left after anodising will continue to oxidise by diffusion of oxygen and/or water vapour from the substrate, increasing the transparency of the product. With freshly metallised film with a low optical density (less than 0.7), it is possible to completely oxidise all residual metal to produce a transparent barrier film.

In order that the process for electrolytically oxidising metallised film may be more readily understood, design of an apparatus for performing this oxidation is shown diagrammatically in the accompanying drawing, where A is a web substrate coated with a thin layer of B, a metal or other conductive material capable of being oxidised. C is an aqueous electrolyte, and F is an electrical power source having a positive terminal G and a negative terminal H. B is made the anode of the electrical circuit, either by direct contact between terminal G and the metal surface or by suspending an electrode P connected to terminal G in the electrolyte close to the metal layer B. D is the cathode of the circuit and is connected to terminal H. By transporting the metallised substrate through the apparatus, the metal layer B is oxidized to produce a substantially transparent oxide or hydroxide E, with barrier comparable to the original metal. The rate of oxidation is controlled by the speed of transport of the substrate, the thickness of the metal layer, the positioning of the electrodes P and D relative to each other and to the metallised layer, the potential difference and the current flow in the circuit, and nature, temperature and conductivity of the electrolyte.

The nature of the substrate is not critical to the invention, being dependent primarily on the proposed end use. The substrate may be electrically conductive or non-conductive. Examples of substrates are plastic films such as polyester, polypropylene, polyethylene, or coated regenerated cellulose film, or paper. The nature of the layer of metal or conductive material B is also dependent primarily on the proposed end use. Metals or conductive materials which do not react with water and which form stable oxides or hydroxides which are not water soluble are desirable. For barrier packaging applications, we prefer to use substrates metallised with aluminium, which are readily available at moderate cost, and, dependent on the substrate, have good oxygen and/or moisture barrier properties. Other metals or conductive materials which may be used include, for example, magnesium, zinc or tin.

The thickness of the metal layer is not inherently critical, the process being operable on substrates coated with metals with an overall optical density up to about 5.0, equivalent to a thickness of approximately 1000 Angstroms (most commercially available metalised films such as the metallised aluminium films commonly used for barrier packaging have optical densities in the range 2.5–3.5). However, as has been explained above, anodising does not take place uniformly because currently available metallised films do not have uniform metallised layers. It is desirable that the thickness of residual metal after anodising is not sufficient to cause significant attenuation of microwave radiation. With a metal such as aluminium, this will occur at an optical density of about 0.18. We have found that, using currently commercially available metallised aluminium films, it is preferable to operate the process on films metallised with aluminium to an optical density of less than 2.0 with an optical density of between 0.2 and 1.0 being especially preferred. However, if higher optical density metallised films are developed which anodise more uniformly without leaving large "islands" of residual metal, there is no inherent reason why the process should not be applicable to them. Similarly, the lower limit on optical density is determined primarily by the barrier requirements of the end use. Currently available aluminium metallised films with optical densities below 0.2 do not have good barrier to oxygen and/or water vapour, but if improved barrier, lower optical density metallised films do become available, there is no inherent reason why they should not be used, provided they have sufficient electrical conductivity.

For reasons described above, we have also found advantages in carrying out the anodising process on metallised film with optical density of less than about 0.7, within 48 hours, and preferably within 12 hours of metallisation, since the residual metal then disappear within a few days due to oxidation via the substrate/metal interface.

The nature of the electrolyte is not critical provided that it has adequate electrical conductivity to sustain the electrolytic process and does not react with either the metal layer on the film or the subsequent oxide or hydroxide layer. We prefer to use a very dilute solution of an acid such as sulphuric acid. More concentrated solutions of acid appear to cause the formation of a non-barrier oxide.

The nature or shape of the electrodes or their orientation with respect to the film is not critical provided that they do not take part in the electrolytic process themselves and lose their conductivity (e.g. aluminium is not suitable as the anode electrode). We prefer to use a static rod or rotating roller as the anode and a plate, rod or mesh as the cathode. If the anode is in contact with the metallised surface, it is preferably in the form of a rotating roller or similar device which will not scratch or damage said surface.

Anode (P) and cathode (D) may be oriented at right angles to the direction of motion of the film, as shown in the diagram, (in which case it is preferred that the cathode is "downstream" of the anode), or parallel to the direction of motion of the film, so that oxidation occurs from the edge. Multiple electrode systems or other electrode orientations may also be used. Either direct or alternating current may be used. We prefer to use direct current.

The process is not limited to the complete electrolytic oxidation of the whole of the metallised layer on the substrate but may also be used to produced patterns of metal and oxide or hydroxide. Stripes of clear oxide or hydroxide can be produced in the metallised layer by using an anode which is the desired width of the clear stripe e.g. a metal roller or plate in contact with or close to the metal surface. More complex patterns can be produced by using as the anode a printing cylinder comprising conductive and non-conductive areas of the desired pattern.

The products of this process, which form the main embodiment of the invention, are oxide or hydroxide coated web materials which are substantially transparent to light and microwave radiation, and which, either in the form of a single web, or in the form of a laminate to either another web of the same said material, or in the form of a laminate to another web material, not having barrier properties, have an oxygen transmission of less than 5 cc/meter$^2$/24 hours at 23° C., 50% RH or an MVTR of less than 5 grams/meter$^2$/24 hours at 38° C., 90% RH. As can be seen from the examples, barrier properties of these oxide or hydroxide coated web materials improve on lamination, even though the lamination is not made using an adhesive which has inherent barrier properties. This synergistic effect on laminate barrier properties is a known phenomenon with oxide coated films reported in U.S. Pat. No. 3,442,686.

In order that the invention may be more fully understood, the following Examples are given by way of illustration only.

EXAMPLE 1

A reel of 12 micron polyester film (commercially available as Melinex 800), having an optical density of 0.05, was metallised on one side with aluminium to an optical density of 0.6, and have an oxygen permeability (at 23° C., 50% RH) of 5.1 cc/meter$^2$/24 hours, and an MVTR (at 38° C., 90% RH) of 6.0 gram/meter$^2$/24 hours. This was unwound through the apparatus shown in FIG. 1. Stainless steel rod was used as the anode, and an aluminium rod as the cathode, with a distance of 5 cm between anode and cathode. The electrolyte was a very dilute (approx 0.01 Molar) solution of sulphuric acid (pH approx 5.0), maintained at approximately 23° C. Potential difference between anode and cathode was 60 volts and current flowing in the circuit was 0.6 amps. Speed was increased until the leading edge of the metallised film (i.e. the point at which it changed from opaque metal to transparent oxide or hydroxide) was about 2 cm from the cathode, and a steady state established. On leaving the electrolytic bath, the film was washed with distilled water and dried using conventional hot air drying. The resultant film had an optical density of 0.08, and when place in a microwave oven did not attenuate the microwaves. A control sample of 0.6 OD metallised film arced, sparked and melted. Oxygen permeability (at 23° C., 50% RH) was 5.4 cc/meter$^2$/24 hours and MVTR (at 38° C., 90% RH) was 6.5 gram/meter$^2$/24 hours. The exact composition of the clear coated surface of the film could not be determined with certainty using the analytical techniques available to the inventor. The oxide coated surface of the film was coated with a commercially available two part polyurethane adhesive, dried to give a dry coat weight of 2.7 grams/meter$^2$ and laminated to a 50 micron low density polyethylene. The resultant laminate had an optical density of 0.08, an oxygen permeability (at 23° C., 50%) of 0.9 cc/meter$^2$/24 hours and MVTR (at 38° C., 90% RH) of 0.85 gram/meter$^2$/24 hours.

A second sample of the oxide coated film was similarly adhesive coated and dried and laminated to the oxide coated surface of another sheet of the same oxide coated film. The resultant laminate, containing two oxide coatings separated by the adhesive, had an optical density of 0.11, (because of scatter of light at the film surface, optical densities are not additive on lamination) and did not spark or heat up when placed in a microwave oven. Oxygen permeability (at 23° C., 50% RH) was 0.24 cc/meter$^2$ 24 hours and MVTR (at 38° C., 90% RH) was 0.20 gram/meter$^2$/24 hours.

EXAMPLE 2

Example 1 was repeated using a 30 micron linear low density polyethylene film, primed and metallised as described in European patent application, No. 89303285.4 and having an optical density of 0.6, an oxygen permeability (at 23° C., 50% RH) of 6.4 cc/meter$^2$/24 hours and an MVTR (at 38° C., 90% RH) of 2.6 gram/meter$^2$/24 hours. After electrolytic oxidation, the resultant film had an optical density of 0.06, and when placed in a microwave oven did not attenuate the microwaves. Oxygen permeability (at 23° C., 50% RH) was 6.5 cc/meter$^2$/24 hours and MVTR (at 38° C., 90% RH) was 2.8 gram/meter$^2$/24 hours. A 12 micron clear polyester film (commercially available as Melinex 800) was coated on one side with a commercially available two part polyurethane adhesive, dried to give a coat weight of 2.6 grams/meter$^2$ and laminated to the oxide coated surface of the above material. The resultant laminate had an optical density of 0.08, an oxygen permeability (at 23° C., 50% RH) of 1.8 cc/meter$^2$/24 hours and an MVTR (at 38° C., 90% RH) of 0.8 gram/meter$^2$/24 hours.

I claim:

1. A process for treating a metallised web of barrier packaging material having an oxygen permeability of less than 5 cc/meter$^2$/24 hours and a moisture vapour transmission rate of less than 5 gram/meter$^2$/24 hours, in order to make it microwave transparent without significant loss of said oxygen permeability and its water vapour transmission rate properties, which comprises passing the metallised film through an electrolytic bath to anodise the metal and convert it to a state selected from its oxide and hydroxide and mixtures thereof, the electrolytic bath containing electrolyte in a concentration of less than about 10% by weight.

2. A process according to claim 1, wherein the electrolyte is an acid which is present in a concentration of less than or equal to 1% by weight.

3. A process according to claim 1 or 2, wherein the metallised web of barrier material is anodised within 48 hours of the web having been metallised.

4. A process according to claims 1 or 2 wherein the metal is selected from Al, Mg, Zn, and Sn.

5. A method of making a microwave transparent barrier packaging material which comprises subjecting a metallised support material to an electrolytic treatment by passing it through an electrolytic bath containing electrolyte in a concentration of less than about 10% by weight to anodise the metal layer so that the treated material has an oxygen permeability of less than 5 cc/meter$^2$/24 hours and a moisture vapour transmission rate of less than 5 gram/meter$^2$/24 hours.

* * * * *